United States Patent [19]

Erickson

[11] Patent Number: 4,596,922

[45] Date of Patent: Jun. 24, 1986

[54] HEATING ELEMENT

[75] Inventor: Ronald E. Erickson, Modesto, Calif.

[73] Assignee: Thermtec, Modesto, Calif.

[21] Appl. No.: 573,831

[22] Filed: Jan. 24, 1984

[51] Int. Cl.[4] ..... F27B 5/14; F27D 11/00; H05B 1/00

[52] U.S. Cl. ..... 219/390; 219/354; 338/294; 373/134

[58] Field of Search ..... 219/390, 345, 354; 338/293, 294; 373/137, 134, 130

[56] References Cited

U.S. PATENT DOCUMENTS

| | | | |
|---|---|---|---|
| 429,560 | 6/1890 | Carpenter | 219/345 |
| 473,133 | 4/1892 | Soden | 219/345 |
| 569,911 | 10/1896 | Custer | 219/390 |
| 1,418,917 | 6/1922 | Hale | 219/345 |
| 2,274,190 | 2/1942 | Cramer | 219/390 |
| 2,545,805 | 3/1951 | Callender | 219/345 |
| 2,680,800 | 6/1954 | Chandler | 219/345 |
| 3,427,011 | 2/1969 | Boyer | 373/130 |

FOREIGN PATENT DOCUMENTS

| | | | |
|---|---|---|---|
| 638250 | 3/1962 | Canada | 219/345 |
| 687332 | 8/1930 | France | 219/390 |
| 149893 | 8/1920 | United Kingdom | 219/390 |
| 390047 | 3/1933 | United Kingdom | 219/345 |

*Primary Examiner*—C. L. Albritton
*Assistant Examiner*—Teresa J. Walberg
*Attorney, Agent, or Firm*—Fliesler, Dubb, Meyer & Lovejoy

[57] ABSTRACT

An energy efficient heating element (10) is set forth which includes a resistance wire (15). The wire (15) has a diameter at 20° C., d, and has a generally sinuated configuration defining a plurality of loops (30). The wire (15) is bent backwards centrally (32) to form first (34) and second (36) generally parallel sections with the loops defining alternately inwardly facing (38*a*) and outwardly facing (38*b*) concavities (38*a*,38*b*) which have respective interior sections (40*a*,40*b*) and mouths (42*a*, 42*b*). The interior sections (40*a*,40*b*) generally have diameters of at least about 3d at 20° C. The mouths (42*a*,42*b*) have dimensions of less than the diameters of the interior sections (40*a*,40*b*) but at least about 2d at actual operating temperature. The closest approaching portions of loops (30) are separated by at least 2d at operating temperature. The wire (15) defines a generally continuous body (44) of thickness, d, at 20° C. The wire (15) is embedded within a ceramic fiber insulating material (14) closely adjacent to a first surface (16) thereof. A black high temperature resistant coating (26) covers the first surface (16).

4 Claims, 5 Drawing Figures

HEATING ELEMENT

TECHNICAL FIELD

This invention relates to an improved heating element useful in furnaces and more particularly to such a heating element for use in tube furnaces utilized in the semiconductor industry.

BACKGROUND ART

The semiconductor industry makes use of relatively large tube furnaces, with the tubes being several feet long and from several inches to a foot or more in internal diameter. These furnaces are used to heat semiconductor wafers which are generally held in quartz tubes within the furnaces. The furnaces must generally be able to heat up to relatively high temperatures, usually from about 300° C. to about 1300° C. A considerable amount of electrical energy is utilized to heat these furnaces to operating temperature and to keep them at that temperature.

The tube furnaces usually utilized in the semiconductor industry have heating elements which consist of a spirally wound coil of very heavy wire, perhaps ¼ inch to ⅜ inch in diameter, and having the axis of the coil coincident with the axis of the tube furnaces with the spirally coiled wire being embedded within insulating material. Generally, the interiors of the furnaces have been the natural color of the ceramic material which is white or off-white.

Such furnaces as are described above have a number of drawbacks. In order to use such heavy wire, it has been necessary to operate at relatively high amperages, generally above 80 amps. This has required the use of relatively expensive stepdown transformers and silicon controlled rectifiers. Furthermore, since the spiral heating elements are generally embedded within an insulating material, a good deal of the energy produced by the elements is, in essence, wasted through dissipation into the insulating material and into the surrounding space. Also, primarily due to the weight of the wire, the furnaces heat up and cool off very slowly and tend to stabilize at a desired temperature relatively slowly. Still further, the relatively light colored interior of the furnace tubes is not of maximum efficiency for transferring energy to objects held within the furnace tube.

Somewhat improved heating elements have been recently developed which utilize considerably thinner heating wires in a sinuated configuration, which wires are near the surfaces of their embedding insulation on the furnace side of such elements. Furthermore, the heating surfaces of such heating elements have generally been colored black so as to improve thermal energy transfer. The size of the heating wire which has been successfully usable in such new heating elements has generally been no greater than about 18 gauge (about 1 mm diameter wire) and such elements have not been sufficient for providing the very high heat needed for such applications as tube furnaces for relatively long periods of time of use. Indeed, such heating elements have generally been available only as flat units for other uses rather than as tubularly shaped units for tube heating furnace use.

It would be very advantageous if a new and lightweight heating element could be provided which would be readily adaptable for use in tube furnaces, would greatly improve the heating efficiency of such tube furnaces with concurrent energy savings, would heat up and cool down quickly, would stabilize relatively quickly at a desired temperature, would provide the high temperatures necessary within tube furnaces and other furnaces, and would last for long periods of time when delivering such heat flux.

DISCLOSURE OF INVENTION

The present invention is directed to overcoming one or more of the problems as set forth above.

In accordance with the present invention, an energy efficient heating element is provided which is designed to operate for long periods of time at an operating temperature in a range from about 300° C. to about 1300° C. The element comprises a resistance wire having a diameter at 20° C., d, having a generally sinuated configuration defining a plurality of loops and being bent backwards centrally to form first and second generally parallel sections with the loops defining alternately inwardly facing and outwardly facing concavities having interior sections and mouths, the interior sections having generally diameters at 20° C. of at least about 3d, the mouths having dimensions of less than the interior sections but at least about 2d at operating temperature, opposite of the loops being separated by at least about 2d at operating temperature, the wire lying so as to define a generally continuous body of thickness, d, at 20° C. A ceramic fiber insulating material is provided having a first surface and a second surface. The wire is positioned closely adjacent to the first surface of the ceramic fiber insulating material with the first surface in generally parallel relation to the body. A dense refractory layer covers the first surface and the wire. A black high temperature resistant coating thinly covers the dense refractory layer.

A heating element as set above has the advantage of using about one half of the energy of prior art heating elements, when used as a tube furnace heating element, for the same internal furnace temperature. Furthermore, such an element is relatively long lasting. Yet further, the heating element as just set out can be utilized with 220 volt or 110 volt current, direct from the line, without the use of a transformer. And, the amperage utilized is relatively low, generally of the order of 10–35 amps. As further advantages yet, the relatively lightweight heating element of the present invention is faster to heat up and cool down and to stabilize at a desired temperature than prior art heating elements utilized for tube furnaces.

BRIEF DESCRIPTION OF THE DRAWINGS

The invention will be better understood by reference to the figures of the drawings wherein like numbers denote like parts throughout and wherein.

BEST MODE FOR CARRYING OUT THE INVENTION

Figure 1:
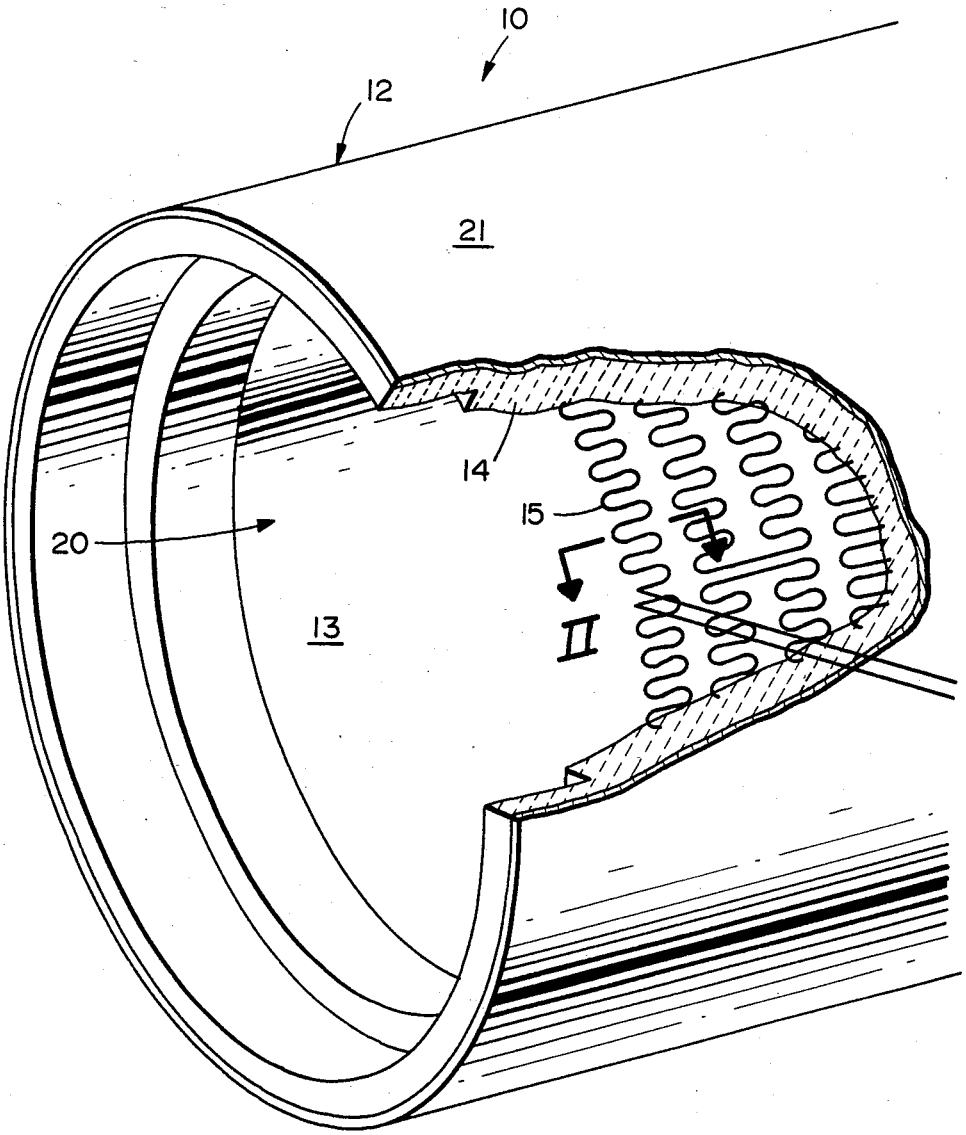
FIG. 1 illustrates, in patially cutaway perspective, a cylindrical heating element in accordance with an embodiment of the present invention.

FIG. 1 illustrates an energy efficient heating element 10 in accordance with the present invention. The heating element 10 shown in FIG. 1 is in the form of a cylindrical tube 12 having an infacing surface 13. The tube 12 is formed of a ceramic fiber insulating material 14 generally formed by conventional vacuum forming techniques. Such material has extremely good thermal insulating properties, is light, and is sufficiently deformable so that a wire 15 which it encloses or abuts and which serves as a heating element can expand and contract as it is heated and cooled without damage to the wire 15 or to the insulating material 14. Various commercial materials may serve as the insulating material 14. For example, such a material is manufactured and sold by Carborundum Corporation (under the trademark "Fiberfrax"), John Mansville Co. (under the trademark "Cerafiber"), Babcock and Wilcox (under the trademark "Kaowool") and C. E. Refractories. Generally, the material includes 40 to 50% each of silica and of alumina.

Figure 2:
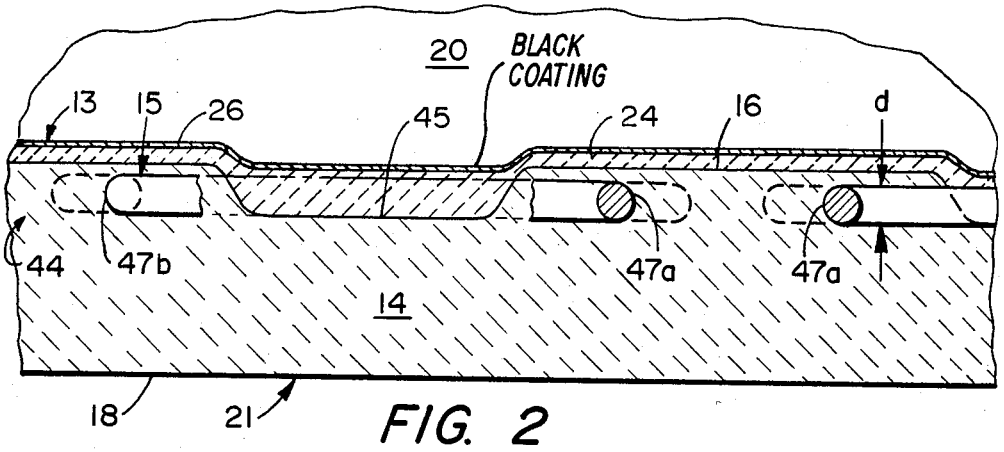
FIG. 2 illustrates a partial view in side section taken along a line II—II of FIG. 1.

Adverting primarily to FIG. 2, the insulating material 14 generally includes a first surface 16 and a second surface 18 with the first surface 16 facing toward an interior 20 of the tube 12 and with the second surface 18 of the insulating material 14 facing toward an outside 21 of the tube 12. In accordance with one embodiment of the present invention, the insulating material 14 is covered with a dense refractory layer 24 over its first surface 16. Such a construction is preferred as it allows easier construction of the heating element 10 and as it provides good conduction of heat away from the wire 15 whereby the wire 15 stays relatively cool whereby its expansion during use is minimized for any particular temperature within the tube 12. Zircon (zirconium oxide) dense refractory material, which is useful as the dense refractory layer 24 is commercially available, for example, from Casting Supply House, Inc., as well as from other suppliers. It has low thermal expansion, high thermal conductivity and chemical inertness.

A black high temperature resistant coating 26 serves to cover the dense refractory layer 24. This serves to aid in radiative heat transfer from the first surface 16 to objects held in the interior 20 of the tube 12. Tempil Division of Big Three Industries, Inc., Series 1200 "Pyromark" (trademark) high temperature paint is a silicone-based coating which withstands the needed temperatures and can be used as the coating 26.

Figure 3:
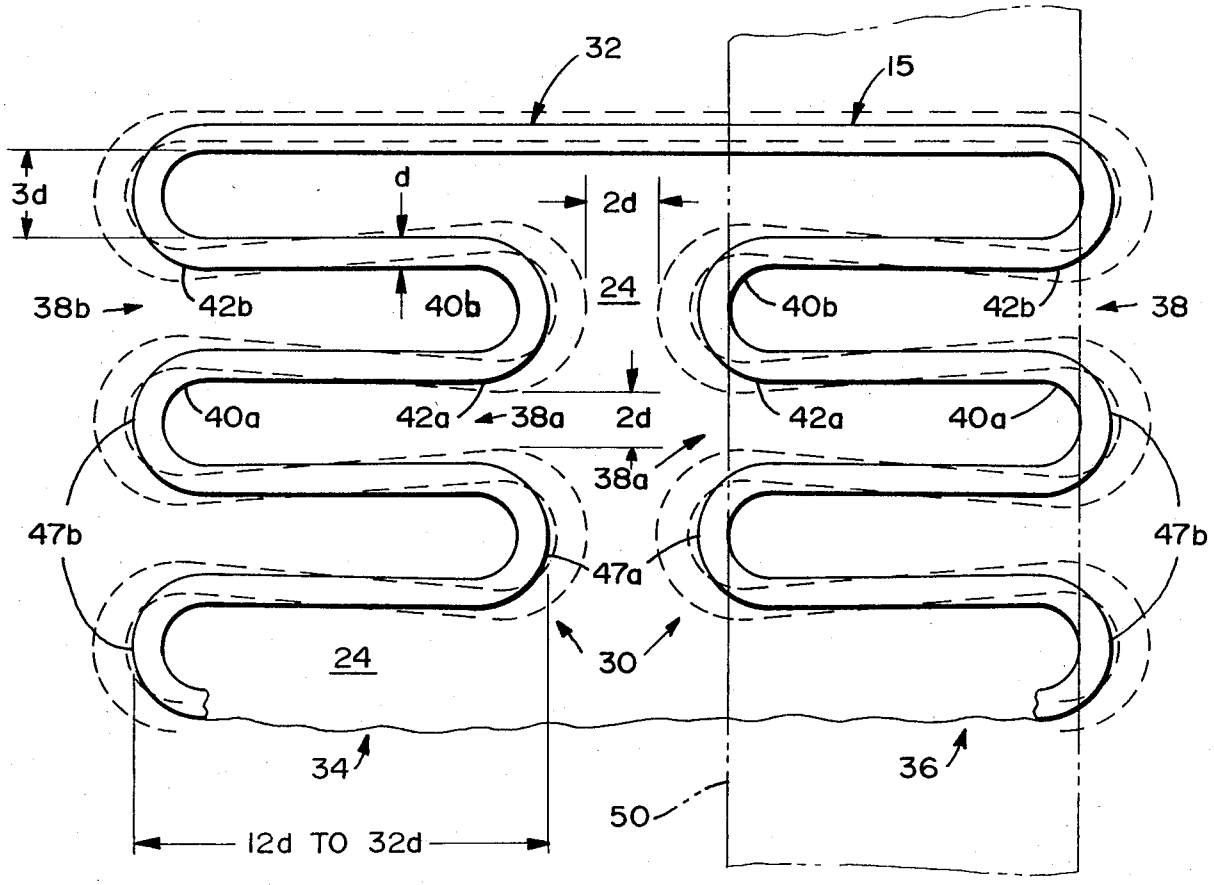
FIG. 3 illustrates, in plan view, a uniquely sinuated wire which forms a portion of a heating element in accordance with an embodiment of the present invention.

In accordance with the present invention, a unique resistance wire 15, seen most clearly in FIG. 3, is required. The resistance wire 15, when at 20° C. has a diameter, d, and also has a generally sinuated configuration defining a plurality of loops 30. The resistance wire 15 is bent backwards centrally, as at 32, to form a first section 34 and a second section 36 which are generally parallel to one another. The loops 30 define alternate inwardly facing and outwardly facing concavities **38*a* and 38*b* having respective interior sections 40*a* and 40*b* and respective mouths 42*a* and 42*b*. The interior sections 40*a* and 40*b* are generally formed by bending the resistance wire 28 about posts of a selected diameter equal to at least 3d whereby the interior sections 40*a* and 40*b* have internal diameters, at 20° C. of at least about 3d. The mouths 42*a* and 42*b* are selected so as to provide minimum separation dimensions of the wire 15 of less than the diameters of the interior sections 40*a* and 40*b* of the concavities 38*a* and 38*b*, i.e., less than about 3d, but at least about 2d even at an operating temperature which falls within a range from about 300° C. to about 1300° C. Further, opposite of the loops 30 must be separated by at least about 2d at such operating temperature. The loops 30** generally extend at least about 12d, and preferably from about 12d to about 32d, at 20° C.

The resistance wire 15 lies so as to define a generally continuous body 44, of a thickness equal to, d, usually either a planar body or a cylindrical body. Other body configurations are also possible, however. When the above set out restrictions in geometric dimensions are observed, heating elements 10 can be manufactured with relatively large size resistance wire 15, for example resistance wire 15 of gauges 17, 16, 15, 14, 13, 12, 11, 10 or the like. If the dimensions are not observed, the heating elements will last a considerably lesser period of time and/or will not do an adequate job of heating. Basically, the design allows for maximum heat flux with minimum wear of the heating element 10 and provides very efficient operation which utilizes only about one half of the energy of prior art tube furnaces and which also provides much more rapid heating and cooling than are attainable in prior art tube furnaces.

Adverting once again to FIG. 2, it will be noted that the ceramic fiber insulating material 14 generally extends from the second surface 18 to slightly above the continuous body 44. A plurality of troughs 45 extend into the ceramic fiber insulating material 14 in the inwardly facing concavities **38*a*, the troughs 45 extending to approximately the bottom of the planar body 44. The dense refractory layer 24 fills in the troughs 45 as well as covering the first surface 16 of the insulating material 14. These portions of the ceramic fiber insulating material 14 opposite inwardly facing ends 47*a* and outwardly facing ends 47*b* of the wire 15 do not have troughs such as the troughs 45 and are instead filled with the relatively soft ceramic fiber insulating material 14. This allows the wire 15 to expand at the ends 47*a* and 47*b* when heated to operating temperature into the relatively soft ceramic fiber insulating material 14. Also, since the dense refractory layer 24 conducts heat away from the wire 15 far more efficiently than does the insulating material 14, the wire 15 is kept relatively cooler than it would be if it was embedded in the bulk of the insulating material 14. As a result, the wire 15 attains a relatively lower temperature for a desired temperature within the heating element 10 with correspondingly less expansion of the wire 15**.

Figure 4:
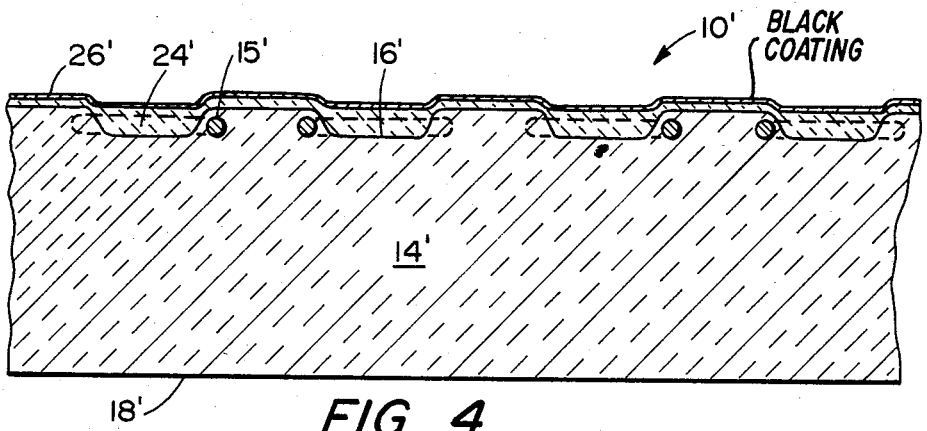
FIG. 4 illustrates, in a view similar to FIG. 2 but on a smaller scale to show additional loops, a flat heating element in accordance with the present invention.

In practice, the resistance wire 15 is bent into the desired shape and is then placed in a vacuum forming mold against one surface of the mold. The mold may be of a shape to provide the cylindrical heating element 10 as seen in FIG. 2 or a flat heating element 10' as seen in FIG. 4. A protective and removable strip 50, shown in phantom in FIG. 3, is positioned to block off the troughs 45. The ceramic fiber insulating material 14 is cast in a vacuum forming cavity into the desired shape and generally partially embeds the resistance wire 15. The strip 50 is then removed exposing the troughs 45. The partially formed heating element 10 or 10' is removed from the vacuum forming cavity, the dense refractory layer 24 is applied, generally as a paste, fills the troughs 45, is allowed to set, and is covered with the black high temperature resistant coating 26.

The diameter, d, of the wire 15, as previously mentioned, can be relatively large. That is, wire 15 of A.W.G. gauge number 17 (1.151 mm) and lesser gauge numbers (greater diameter wire), e.g., gauge number 10, can be utilized. Generally, the diameter, d, at 20° C. will be at least about 1.0 mm so as to provide sufficient heating for high temperature applications and sufficient lifetime for the heating element 10. Generally, the resistance of the wire 15 will fall within the range from between about 0.85 ohm per foot (0.028 ohm per centimeter) to about 0.08 ohm per foot (0.0027 ohm per centimeter).

Figure 5:
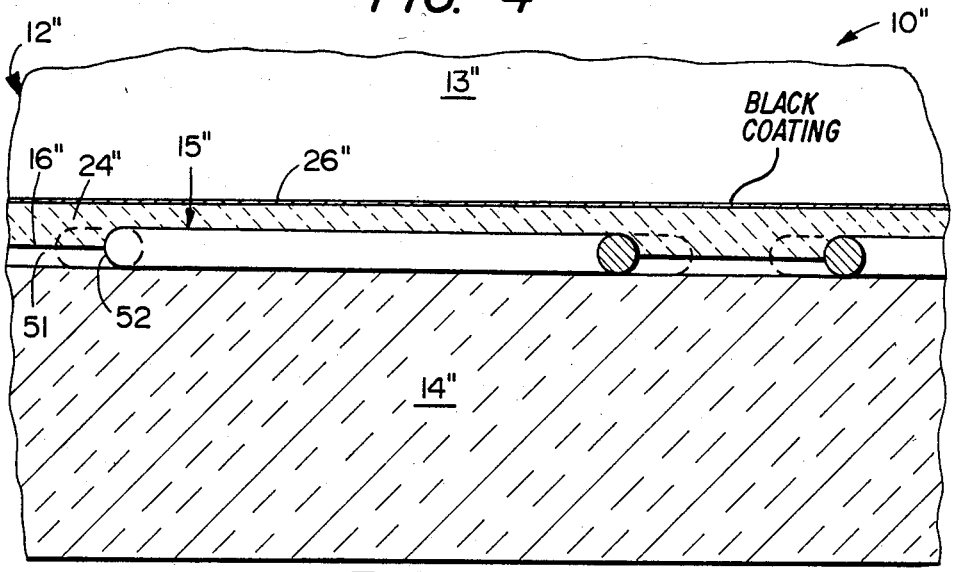
FIG. 5 illustrates, in a view similar to FIG. 2, an alternate embodiment of the present invention.

FIG. 5 shows an alternate embodiment of the invention. A wire 15'' is positioned against a first surface 16'' of a ceramic fiber insulating material 14''. The first surface 16'' may be flat or may have shallow grooves 51 which mate with an outfacing portion 52 of the wire 15. A dense refractory layer 24'' covers the wire 15'' and is itself thinly covered with a black high temperature resistant coating 26'' of a heating element 10''. While the dense refractory layer 24'' is relatively dense and will not give like the ceramic fiber insulating material 14'', the wire 15'' can still expand on heating the interior of a tube 12'' to 300° C. to 1300° C. without being itself damaged and without damaging the dense refractory layer 24''. This is possible since the dense refractory layer 24'' conducts heat away from the wire 15'' relatively rapidly thus keeping its temperature (and thermal expansion) relatively low for any specified temperature in the interior of the tube 12''.

INDUSTRIAL APPLICABILITY

The heating element 10 of the present invention finds particular use in tube furnaces which are used in the semiconductor industry to heat semiconductor wafers held in quartz tubes or the like.

Although the foregoing invention has been described in some detail by way of illustration of a specific embodiment thereof for the purposes of clarity of understanding, it should be recognized that a number of changes and modifications may be practiced of the present invention which will still fall within the scope of the invention and of the appended claims.

I claim:

1. An energy efficient heating element (10, 10', 10'') capable of operating for extended periods of time at an operating temperature which falls within a range from about 300° C. to about 1300° C., comprising:

a resistance wire (15, 15', 15'') having a diameter at 20° C., d, a generally sinuated configuration defining a plurality of loops (30) and being bent backwards centrally (32) to form first (34) and second (36) generally parallel sections (34,36) with said loops (30) defining alternate inwardly facing (**38*a*) and outwardly facing (38*b*) concavities (38*a*,38*b*) having interior sections (40*a*,40*b*) and mouths (42*a*,42*b*), said interior sections (40*a*,40*b*) having diameters at 20° C. of at least about 3d, said mouths (42*a*,42*b*) having dimensions of less than the diameters of the interior sections (40*a*,40*b*) but at least about 2d at said operating temperature, said loops (30) having inwardly facing ends (47*a*) which are separated where they most closely approach one another by at least about 2d at said operating temperature, said resistance wire (15) lying so as to define a generally continuous body (44**) of thickness, d, at 20° C.;

a ceramic fiber insulating material (14,14',14'') having a first surface (16,16',16'') and a second surface (18,18',18''), said resistance wire (15,15',15'') being positioned closely adjacent to said first surface (16,16',16'') with said first surface (16,16',16'') in generally parallel relation to said continuous body (44);

a dense refractory layer (24,24',24'') covering said wire (15,15',15'') and said first surface (16,16',16''); and a black high temperature resistant coating (26,26',26'') covering said dense refractory layer (24,24',24'');

wherein said first surface (16,16') has a plurality of troughs (45) in said inwardly facing concavities (**38*a*), said troughs (45) extending generally through said continuous body (44,44'); and wherein said dense refractory layer (24,24'**) fills said troughs.

2. A heating element (10,10') as set forth in claim: 1, wherein said parallel sections (34,36) extend laterally at 20° C. from about **12*d* to about 32*d***.

3. A heating element (10,10') as set forth in claim 1, wherein said wire (15,15') has opposite outwardly facing ends (**47*b*) and wherein said ceramic fiber insulating material (14,14') is opposite said inwardly facing ends (47*a*) and said outwardly facing ends (47*b***).

4. A heating element (10,10') as set forth in claim 1, wherein said inwardly facing ends (**47*a***) are opposite one another.

* * * * *